US007220068B2

(12) United States Patent
Silverbrook

(10) Patent No.: US 7,220,068 B2
(45) Date of Patent: May 22, 2007

(54) DIGITAL STAMP

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 10/503,920

(22) PCT Filed: Feb. 12, 2003

(86) PCT No.: PCT/AU03/00152

§ 371 (c)(1),
(2), (4) Date: Aug. 9, 2004

(87) PCT Pub. No.: WO03/068519
PCT Pub. Date: Aug. 21, 2003

(65) Prior Publication Data

US 2005/0201809 A1 Sep. 15, 2005

(30) Foreign Application Priority Data

Feb. 13, 2002 (AU) ..... PS0489

(51) Int. Cl.
*B41J 3/36* (2006.01)
*B41J 2/01* (2006.01)
*B41J 29/00* (2006.01)

(52) U.S. Cl. ..... 400/88; 347/109

(58) Field of Classification Search ..... None
See application file for complete search history.

(56) References Cited

U.S. PATENT DOCUMENTS 3,714,894 A * 2/1973 Robinson ..... 101/389.1

(Continued)

FOREIGN PATENT DOCUMENTS

DE 3806356 A 6/1988

(Continued)

OTHER PUBLICATIONS

Machine translation of JP 2001071567 to Fujita from Japanese Patent Office website.*

*Primary Examiner*—Daniel J. Colilla

(57) ABSTRACT

A digital stamp is described which can print out a message using a moveable inkjet printhead (30) which can be moved by a mechanical arrangement of arm (35) and pivots (33, 36). A cartridge (20) containing ink feeds the printhead (30) with monochrome or color ink via lines (52). Movement of the upper section (10) of the housing towards the lower section (12) of the housing moves the arm (35) to slide the printhead (30) across the aperture (34) in the lower section (12) while at the same time electronic signals fed to the printhead (30) print out the stored message. A spring (42) returns the printhead (30) to its inoperative position once having traversed the opening (34). The stored message may be fixed, replaceable or programmable or may be one from a fixed number of stored or updateable messages or images or can be input by an attached apparatus, for example, a CCD imager, to record an image and to print it via the printhead (30). The digital stamp can replace a rubber stamp in an office or may be used to print labels in a retail environment. An infra-red ink may also be supplied which can be used to print an encoded digital message with or on top of a visual print-out as a security measure when a printhead having the necessary number of inkjet nozzles is employed.

16 Claims, 11 Drawing Sheets

U.S. PATENT DOCUMENTS

| | | | | |
|---|---|---|---|---|
| 5,195,832 | A * | 3/1993 | Fujikawa et al. | 400/120.13 |
| 5,673,371 | A * | 9/1997 | Koopman et al. | 358/1.11 |
| 6,102,505 | A * | 8/2000 | McIntyre et al. | 347/2 |
| 6,474,773 | B1 * | 11/2002 | Silverbrook et al. | 347/29 |
| 6,733,117 | B2 * | 5/2004 | Tajima et al. | 347/87 |
| 6,991,332 | B1 * | 1/2006 | Fan et al. | 347/109 |
| 2003/0106447 | A1 * | 6/2003 | Walling | 101/327 |
| 2005/0162488 | A1 * | 7/2005 | Matsuzaki et al. | 347/85 |

FOREIGN PATENT DOCUMENTS

| | | | |
|---|---|---|---|
| JP | 09277614 | A * | 10/1997 |
| JP | 2001071567 | A * | 3/2001 |
| WO | WO 0054979 | A | 9/2000 |
| WO | WO 107261 | A1 * | 2/2001 |

* cited by examiner

DIGITAL STAMP

This application is a national phase application (371) of PCT/AU03/00152 filed on Feb. 12, 2003, the entire contents of which are herein incorporated by reference.

FIELD OF INVENTION

The present invention relates to a hand held stamp for printing on a stationary print medium.

BACKGROUND OF THE INVENTION

Rubber stamps have been known for a long time and embody a variety of constructions including a fixed face or a movable face. In the latter the inked rubber surface is moved vertically into contact with the paper or media being stamped. The stamp is normally a fixed message and cannot be altered. In some cases, however, a series of numbers or letters can be provided on a closed loop, configured such that one of the series is presented for printing at any one time. A common example of such a stamp is an adjustable date stamp.

A number of fixed stamps are employed in office to apply short messages, frequently used messages to paperwork in a relatively permanent way (for example, "Faxed"; "Copy"; or "Confirmation" stamps). This creates considerable inventory as well as a limitation that any different message requires a new stamp to be created and, once created, the new stamp has only one functional purpose.

While rubber stamps are common in office environments there are other types of markers. Stencils are one such type and it is contemplated that the instant invention may be used in place of stencils.

CO-PENDING APPLICATIONS

Various methods, systems and apparatus relating to the present invention are disclosed in the following co-pending applications filed by the applicant or assignee of the present invention simultaneously with the present application:

| | | |
|---|---|---|
| PCT/AU03/00150 | PCT/AU03/00154 | PCT/AU03/00151 |
| PCT/AU03/00152 | PCT/AU03/00145 | PCT/AU03/00153 |
| PCT/AU03/00170 | PCT/AU03/00168 | PCT/AU03/00169 |
| PCT/AU03/00146 | PCT/AU03/00159 | PCT/AU03/00162 |
| PCT/AU03/00149 | PCT/AU03/00167 | PCT/AU03/00171 |
| PCT/AU03/00147 | PCT/AU03/00166 | PCT/AU03/00158 |
| PCT/AU03/00163 | PCT/AU03/00165 | PCT/AU03/00164 |
| PCT/AU03/00157 | PCT/AU03/00148 | PCT/AU03/00160 |
| PCT/AU03/00155 | | PCT/AU03/00156 |

The disclosures of these co-pending applications are incorporated herein by cross-reference.

RELATED PATENT APPLICATIONS AND PATENTS

| | | | | |
|---|---|---|---|---|
| 6566858 | 6331946 | 6246970 | 6442525 | PCT/AU01/00141 |
| 09/505951 | PCT/AU01/00139 | 6816968 | 6757832 | PCT/AU01/00140 |
| PCT/AU00/00741 | 6238044 | PCT/AU00/00742 | 6425661 | 6227652 |
| 6213588 | 6213589 | 6231163 | 6247795 | 6394581 |
| 6244691 | 6257704 | 6416168 | 6220694 | 6257705 |
| 6247794 | 6234610 | 6247793 | 6264306 | 6241342 |
| 6247792 | 6264307 | 6254220 | 6234611 | 6302528 |
| 6283582 | 6239821 | 6338547 | 6247796 | 6557977 |
| 6390603 | 6362843 | 6293653 | 6312107 | 6227653 |
| 6234609 | 6238040 | 6188415 | 6227654 | 6209989 |
| 6247791 | 6336710 | 6217153 | 6416167 | 6243113 |
| 6283581 | 6247790 | 6260953 | 6267469 | 6273544 |
| 6309048 | 6420196 | 6443558 | 6439689 | 6378989 |
| 6848181 | 6634735 | PCT/AU98/00550 | PCT/AU00/00095 | 6390605 |
| 6322195 | 6612110 | 6480089 | 6460778 | 6305788 |
| PCT/AU00/00172 | 6426014 | PCT/AU00/00338 | 6364453 | PCT/AU00/00339 |
| 6457795 | PCT/AU00/00581 | 6315399 | PCT/AU00/00580 | 6338548 |
| PCT/AU00/00582 | 6540319 | PCT/AU00/00587 | 6328431 | PCT/AU00/00588 |
| 6328425 | PCT/AU00/00589 | 6991320 | PCT/AU00/00341 | 6595624 |
| PCT/AU00/00340 | PCT/AU00/00749 | 6417757 | PCT/AU01/01332 | 7095309 |
| PCT/AU01/01318 | 6854825 | PCT/AU00/00750 | 7075677 | PCT/AU00/00751 |
| 6428139 | PCT/AU00/00752 | 6575549 | PCT/AU01/00502 | PCT/AU00/00583 |
| 6383833 | PCT/AU02/01120 | PCT/AU00/00593 | 6464332 | PCT/AU00/00333 |
| PCT/AU00/01513 | 6428142 | PCT/AU00/00590 | 6390591 | PCT/AU00/00591 |
| 7018016 | PCT/AU00/00592 | 6328417 | PCT/AU00/00584 | 6322194 |
| PCT/AU00/00585 | 6382779 | PCT/AU00/00586 | 6629745 | PCT/AU00/01514 |
| 6565193 | PCT/AU00/01515 | 6609786 | PCT/AU00/01516 | 6609787 |
| PCT/AU00/01517 | 6439908 | PCT/AU00/01512 | 6684503 | PCT/AU00/00753 |
| 6755513 | PCT/AU00/00594 | 6409323 | PCT/AU00/00595 | 6281912 |
| PCT/AU00/00596 | 6604810 | PCT/AU00/00597 | 6318920 | PCT/AU00/00598 |
| 6488422 | PCT/AU01/01321 | 6655786 | PCT/AU01/01322 | 6457810 |
| PCT/AU01/01323 | 6485135 | PCT/AU00/00516 | 6795215 | PCT/AU00/00517 |

SUMMARY OF THE INVENTION

In accordance with the invention, there is provided a marking device for printing indicia on print media, the marking device including:

a housing;

a printing mechanism within the housing, including: a printing means for printing said indicia; storage means for storing information required to print said indicia; moving means for moving said printing means with respect to said housing and said print media during printing; processor means for processing said information and for controlling said printing means to print said indicia as said printing means is moved with respect to said print media.

By using a compact, movable printhead, a digital stamp can print a single message or a plurality of separate messages and can be made so that the message(s) can be either pre-programmed or programmable. In the latter case, the programmability of the stamp may be done via a link to a computer system, via a separate module which can be attached to the stamp device, or by some other method within the knowledge of a person skilled in the art.

Preferably, the printing means is an inkjet printhead.

Preferably, printing only occurs when said housing is in contact with print media.

Preferably, the housing has an aperture through which said printing means can print when said means for moving said printing means is operative with said housing in contact with said print media.

The means for moving the printing means may operate either manually or automatically.

Preferably, the printing mechanism includes ink supply means accommodated within said housing which are modular and may be replaceable.

Print media includes any material suitable for printing thereon such as paper products, fabric, plastics material, and metallic film or other film so treated as to allow fixing and/or absorption of the ink employed. In addition, the properties and characteristics of the ink may be adjusted to improve the fixing and/or absorption of the ink with a particular or range of print media.

BRIEF DESCRIPTION OF THE DRAWINGS

Preferred embodiments of the invention will now be described with respect to the following figures in which.

PREFERRED MODES OF PERFORMING THE INVENTION

Figure 1:
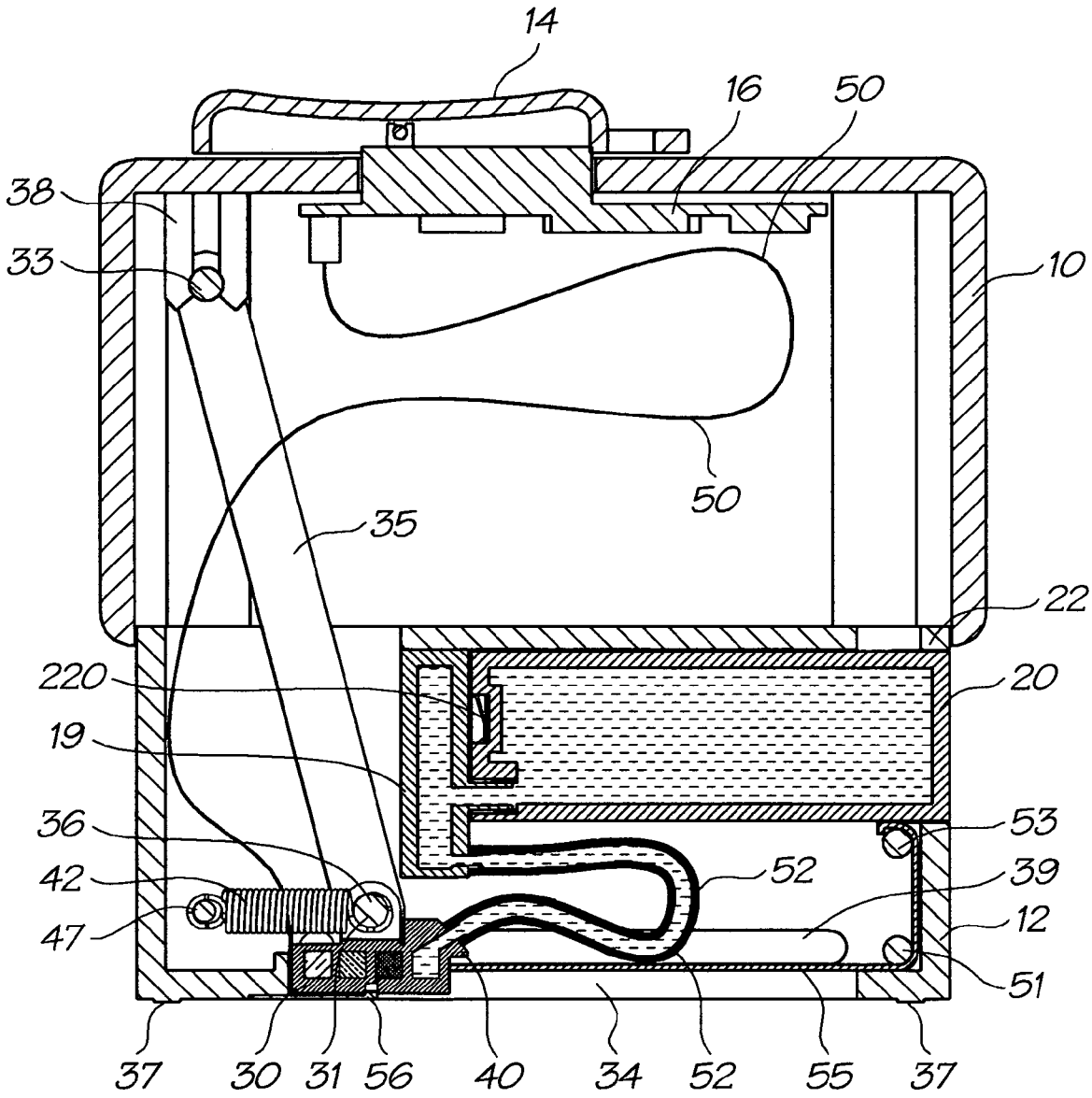
FIG. 1 shows a cross sectional schematic of a stamp according to a first embodiment of the invention in a first position.
Figure 2:
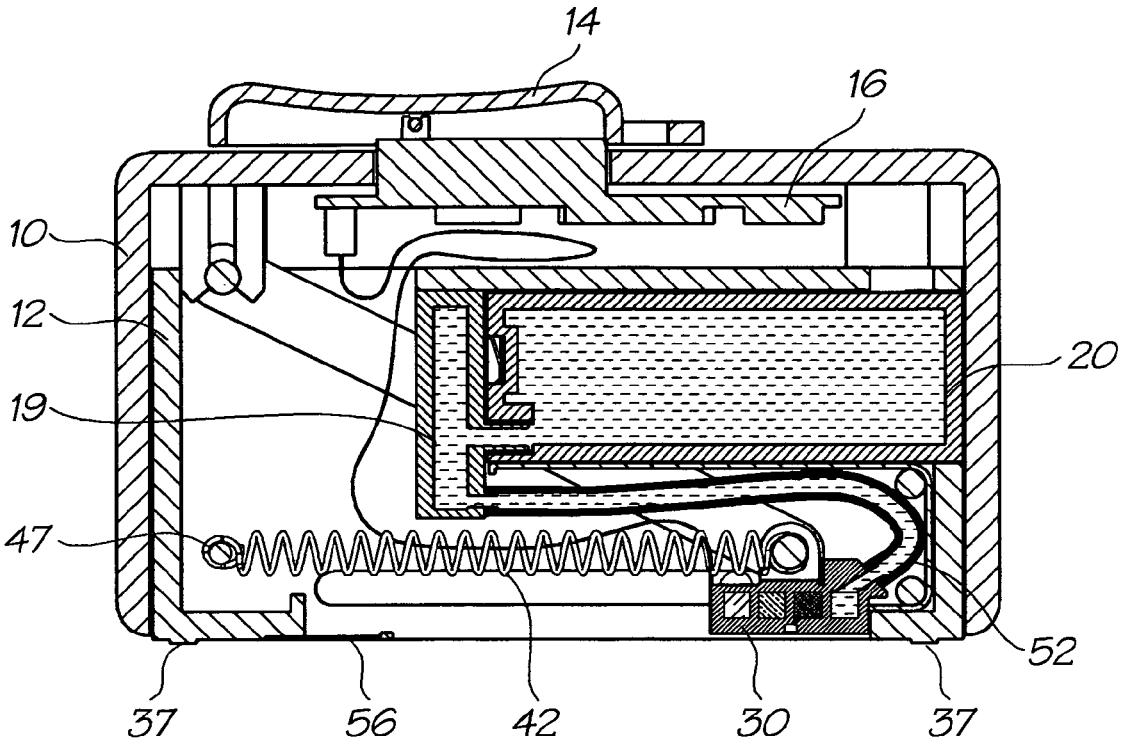
FIG. 2 shows a cross sectional schematic of the stamp of FIG. 1 in a second, operative position.
Figure 3:
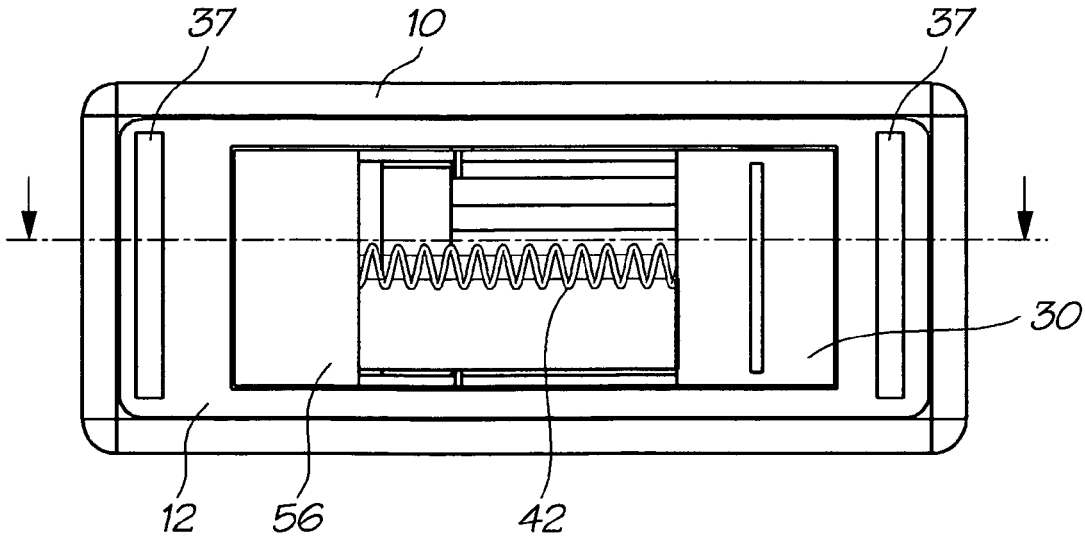
FIG. 3, shows an underneath view of FIG. 2.

Referring to FIG. 1, the stamp according to one embodiment of the invention comprises a housing having two parts, an upper part 10 and a lower part 12 with the upper part 10 of the housing moveable with respect to the lower part or base 12 of the housing. FIG. 1 shows the stamp with the housing in the inoperative or extended position while FIG. 2 shows the stamp in its operative mode towards the end of a stamping operation.

Fixed to the outside of the upper housing 10 is a slide 14 which is fixed to a printed circuit board 16 on the inside of the upper housing 10. In the lower housing 12, a printhead 30 is located at one end 32 of an opening 34 in the lower housing 12 and is supplied with ink from ink cartridge 20 via ink connector 19 and tubes 52. The printed circuit board (PCB) 16 has the necessary solid state memory 15 and processing capabilities to operate the printhead 30 and control other function within the stamp housing, such as detecting the presence or absence of an ink cartridge 20. Solid state memory includes, for example, ROM, PROM, EEPROM or low power consumption RAM such as CMOS, DRAM or SRAM devices.

Slide 14 is used to select what indicia are to be printed as stored in memory 15. The slide 14 may be a potentiometer whose resistance value is interpreted by circuitry on PCB 16 to select a print choice from memory 15, or may be a selector switch which chooses the required print by contacting conductor strips or fingers on PCB 16 which strips are coded for the desired location in memory 15. The selector switch may be a linear slide switch, as shown, or may be a rotary switch.

A battery (not shown) for operating the printhead 30 can be accommodated in or associated with the ink cartridge 20 which is supported on base moulding 22.

Figure 5:
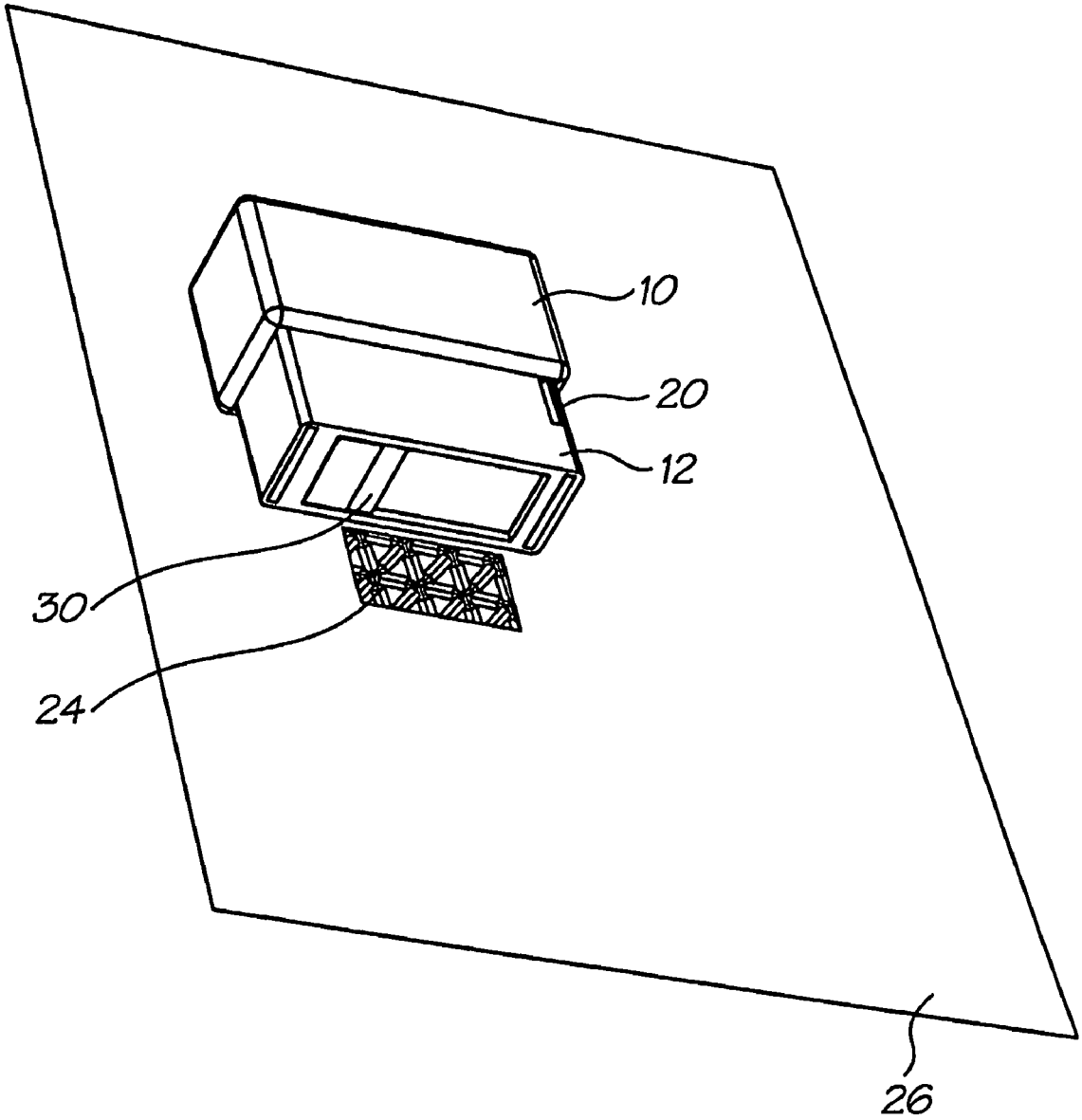
FIG. 5 shows an example of use of the stamp of FIG. 1.

The printhead 30 moves across the opening 34 and in doing so prints the selected indicia 24, characteristic of the stamp, for example as illustrated in FIG. 5, on print media 26. The printhead 30 may be moved by an electrical motor or by various mechanical arrangements or a combination of motor and mechanical linkage. Typical mechanical arrangements may be rack and pinion, peg and groove or rack and pinion and worm screw.

Figure 4:
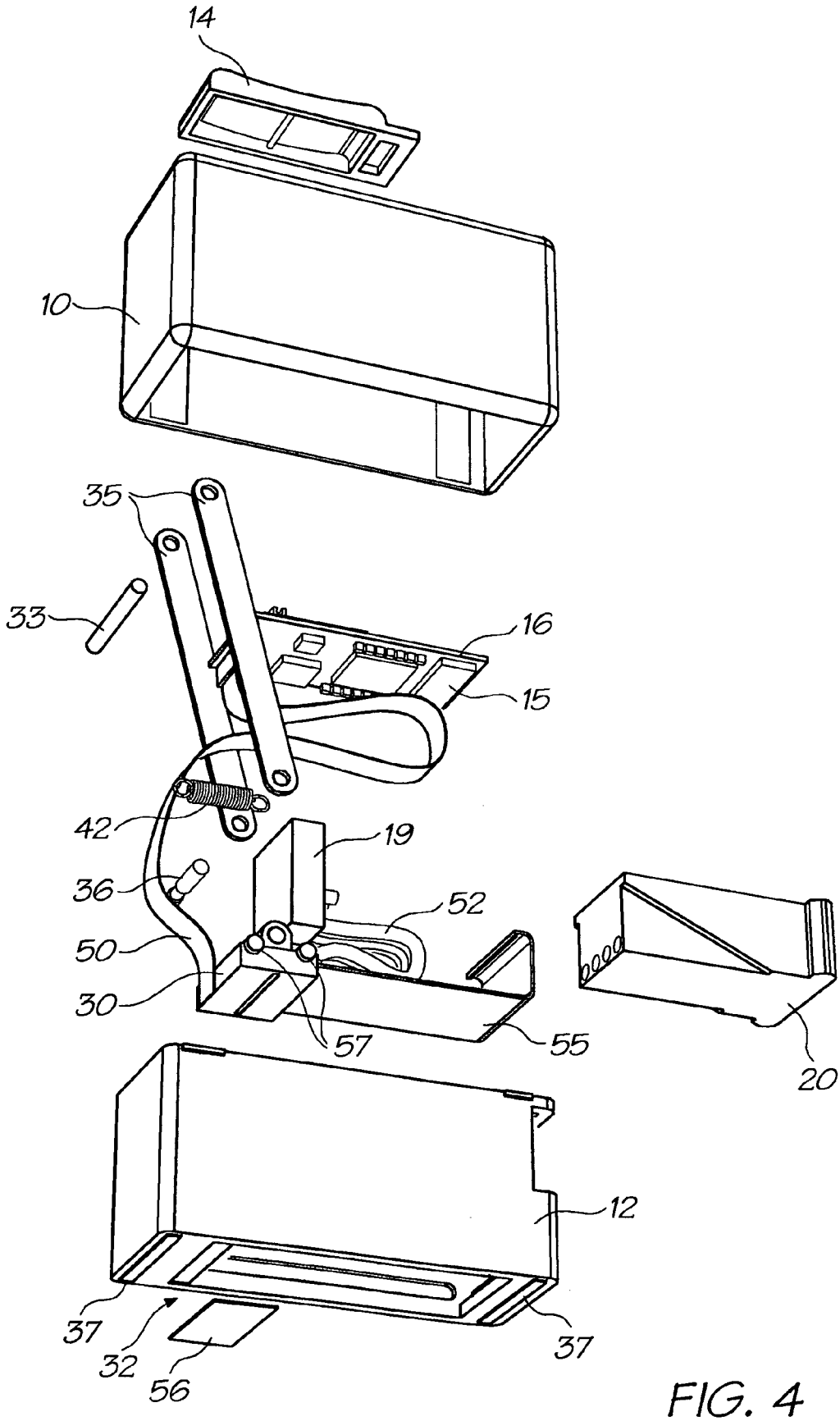
FIG. 4, shows an exploded view of the embodiment of FIG. 1 illustrating the components thereof.

In the embodiment shown in FIG. 1, the printhead 30 is moved across the opening 34 by a mechanical mechanism comprising a pair of arms 35 fixed at one end to the top 36 of the printhead 30 by axle 31 and at their other end to a bracket 38 of the upper housing 10 by axle 33. A pair of pulley wheels or bearings 57 fixed to printhead 30 (see FIG. 4) engage in slot 39 to constrain the motion of the printhead 30 to a linear motion across the opening 34. As the upper housing 10 is moved toward the lower housing 12 by manual action the arms 35 move the printhead 30 from left, as shown in FIG. 1, to the right, as shown in FIG. 2. At the same time, the printhead 30 is activated to print the indicia required. The printhead 30 is supplied with information and activating signals from the processing circuitry on PCB 16 via the wires 50 and with ink from the ink cartridge 20 via ink connector 19 and tubes 52. A four ink (red, yellow, cyan, black) printhead is illustrated although printheads having from one to six inks can be employed as disclosed in applicant's applications listed in the appendix.

A return spring 42 is fixed between a stationary part 47 of the lower housing 12 and axle 31 on printhead 30 and ensures that the printhead 30 and upper housing 10 will return to their initial starting positions as shown in FIG. 1, upon release of the pressure from the upper housing 10.

A tambour or shutter 55 covers the opening 34 when the stamp is not in use (see FIG. 1). The tambour 55 is attached to the ledge 40 of printhead 30. As the printhead 30 moves across the opening 34 the tambour 55 is moved around the rollers or bearings 51, 53 and along the base of the ink cartridge 20. The tambour 55 is shown in its fully retracted state in FIG. 2. When spring 42 returns the printhead 30 to its rest position the tambour 55 is drawn back to cover the opening 34 as shown in FIG. 1.

A copper arm 56 extends from the lower housing 12 to cover the printhead 30 when in the "home position" as shown in FIG. 1. In this way the face of the printhead 30 is protected from dirt and damage. The copper arm 56 may further include a sponge or other absorbent material for collecting drips or extraneous ink between runs of the printhead 30. The copper arm 56 may also act as a lever to contact a microswitch (not shown) when the arm 56 is pressed onto print media to activate the circuitry controlling the printing by printhead 30. A pair of rubber feet 37 supports the lower housing 12 and hence printhead 30 away from any support surface or the surface of the print media when printing. Printhead 30 is an inkjet printhead and the thickness of the feet 37 spaces the printhead 30 from the print media without interfering in the operation thereof.

A sensor (not shown) for example, a CCD image sensor, may be provided on the side of the printhead 30 to detect the position of the printhead 30 with respect to the housing to co-ordinate printing by the printhead 30. Signals from the CCD image sensor are fed to circuitry on PCB (printed circuit board) 16 for processing. This circuitry controls the operations of the printhead 30. The printhead 30 is a type of electromechanically driven inkjet printhead and the circuitry provides the signals to the respective ink nozzles required to print the message stored in ROM or RAM on the PCB 16.

The ink cartridge 20 is replaceable so that the stamp can be reused once the ink supply has been exhausted. It is also contemplated that a stamp may be used once only and therefore that the ink cartridge 20 is not designed to be replaceable in some forms of the invention.

Figure 6:
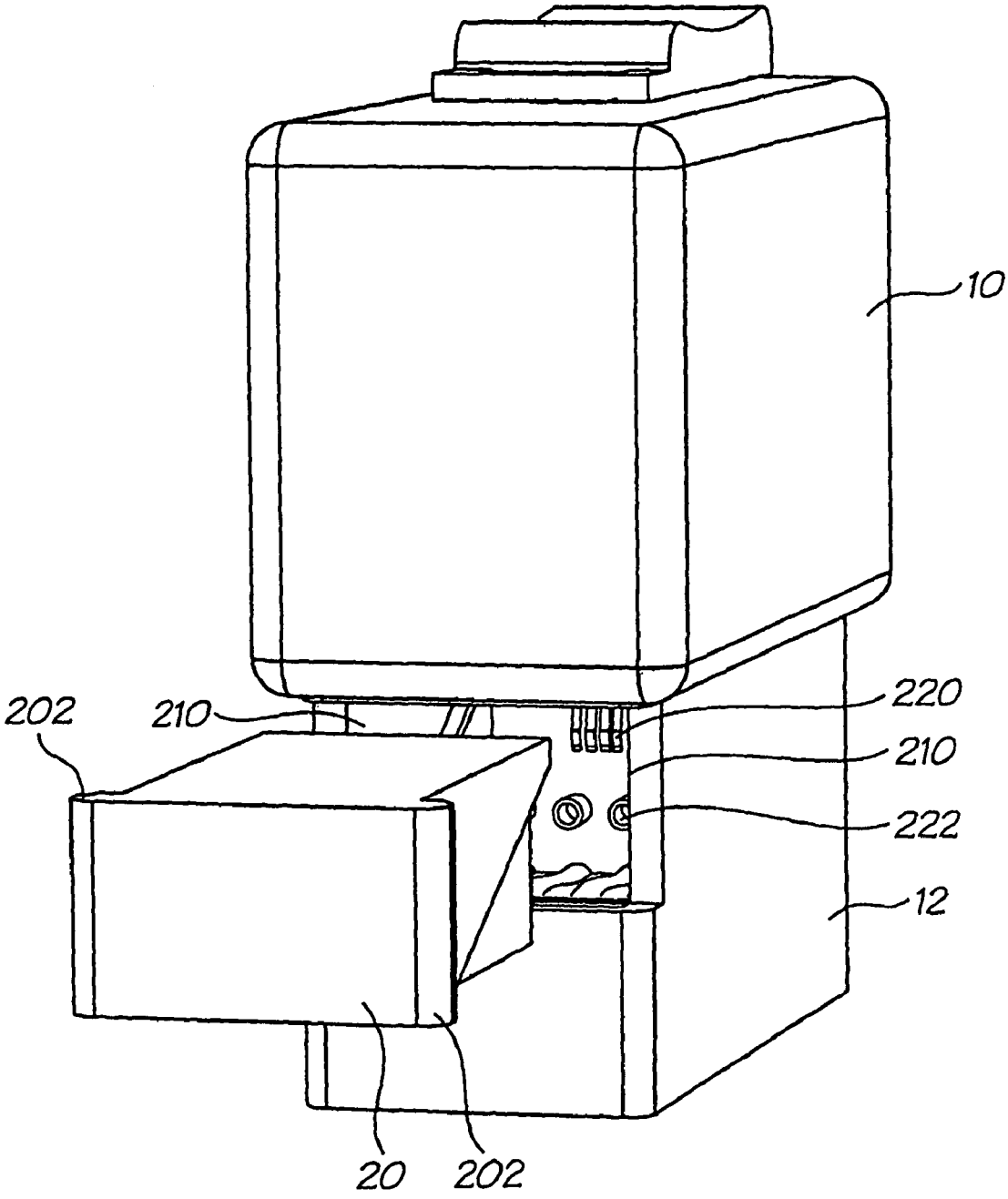
FIG. 6 shows a cartridge being mated with the body of the stamp of FIG. 1.
Figure 7:
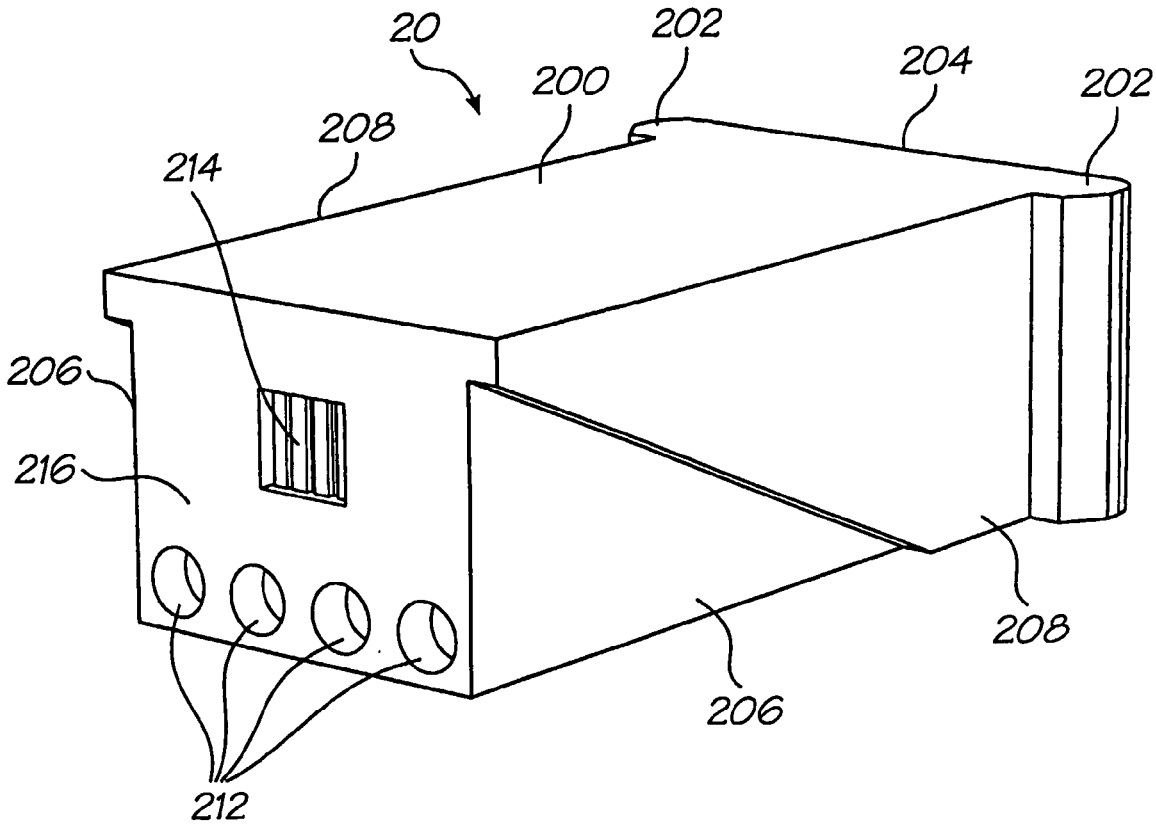
FIG. 7 shows one embodiment of a cartridge according to the invention for use with the embodiment of FIG. 1.

One embodiment of a replaceable cartridge 20 is shown in FIG. 7. It comprises a body 200 having flanges 202 at the front face 204 for grabbing and wedge-shaped cut-outs 206 at the sides 208 for mating with complimentary structures on the inside of the side walls 210 of the lower housing 12. Ink outlets 212, four in number are shown, provide access to separate internal compartments storing each of the four inks. A printed circuit chip 214 is fixed to the rear 216 of the cartridge 20 and is encoded with details of the cartridge 20 such as the features (number, colours) and characteristics (viscosity, use by date) of the ink or inks used so that when inserted into the housing the chip 214 contacts a receiving connector dock 220 (see FIG. 6) whereby these details may be read by the processing circuitry on PCB 16. The ink outlets 212 mate with inlet sockets 222 on the ink connector 19. The connector 19 is provided with means for rupturing seals (not shown) in the ink outlets 212 of the cartridge 20 when the cartridge 20 is first installed. For example, the inlets 222 may have sharp metal edges for doing this. The ink cartridge 20 may also include a battery pack with enough energy to operate the printhead 30 for the duration of the ink supply. Alternatively, provision for a battery pack may be provided elsewhere within the housing to fulfil these requirements or to supplement them.

The printhead 30 can be of a type of sufficient size and detail to print across and along the opening 34 but preferably involves an inkjet printhead of a type such as disclosed in the inventor's earlier applications as listed below in the Appendix.

The stamp according to the invention may be operated mechanically, as described above, or may be operated fully electrically, in which case the upper housing need not be made moveable with respect to the base housing but the two housings could be of a fixed configuration.

Other ways of moving the printhead 30 are also contemplated, including using a DC or an AC motor under internal power or through an external power connection. Regulation of the motion of the printhead 30 may be provided by a mechanical governor or by the control circuitry for the motor such as by using a stepper motor or a synchronous AC motor.

As an alternative to the CCD image sensor, positioning of the printhead 30 may be sensed by an optical quadrature wheel.

Figure 9:
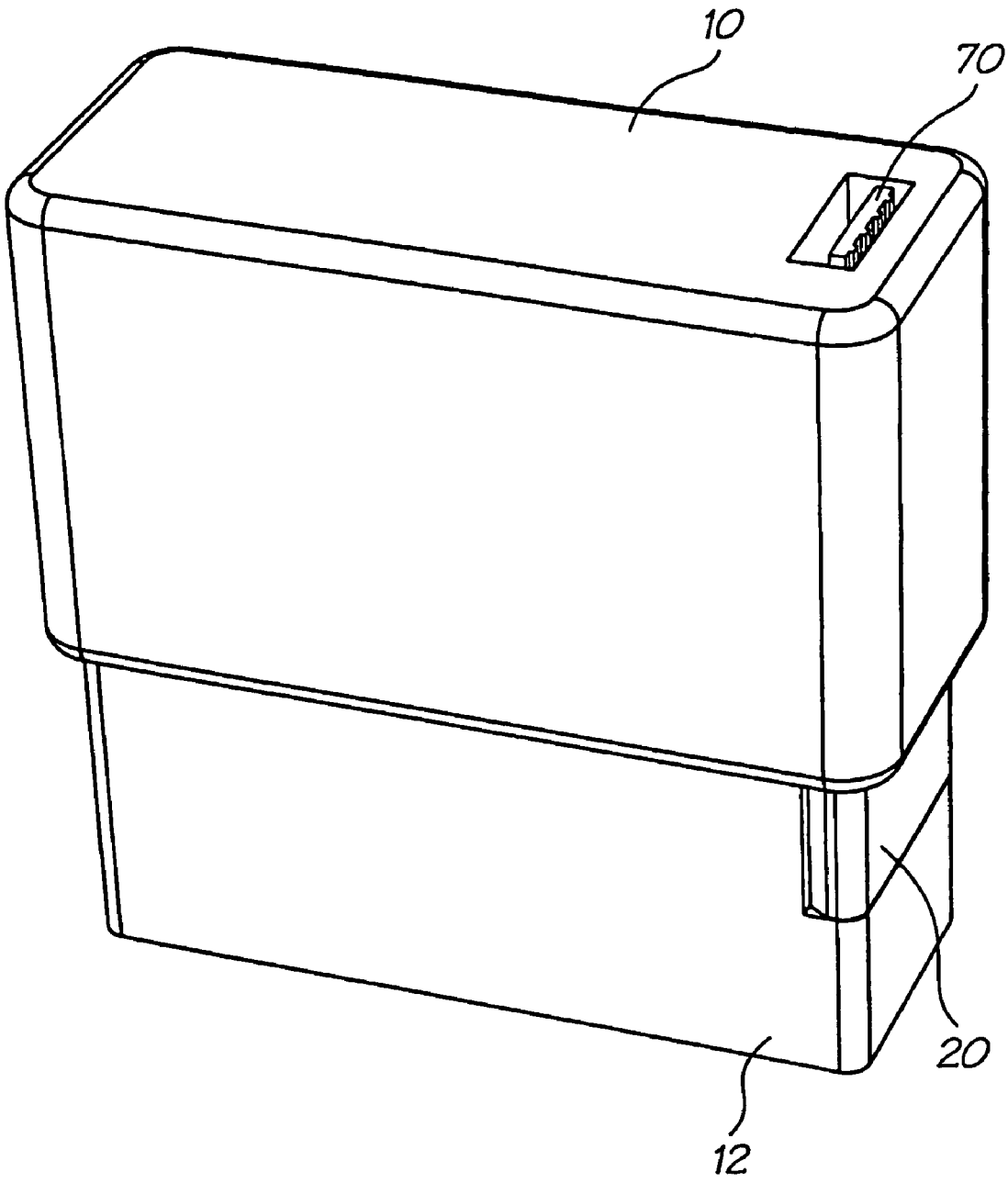
FIG. 9 shows schematically a third embodiment of the invention.

If the stamp is electrically powered, the power may be provided internally either from a separate battery pack, from a battery integral with the ink cartridge, from a generator or dynamo operated when the upper housing is moved downwardly, as described above, or by an external wired connection, for example a USB (Universal Serial Bus) connection (see FIG. 9).

Various embodiments of the stamp are contemplated and four further embodiments thereof are shown in FIGS. 8–11 respectively.

Figure 8:
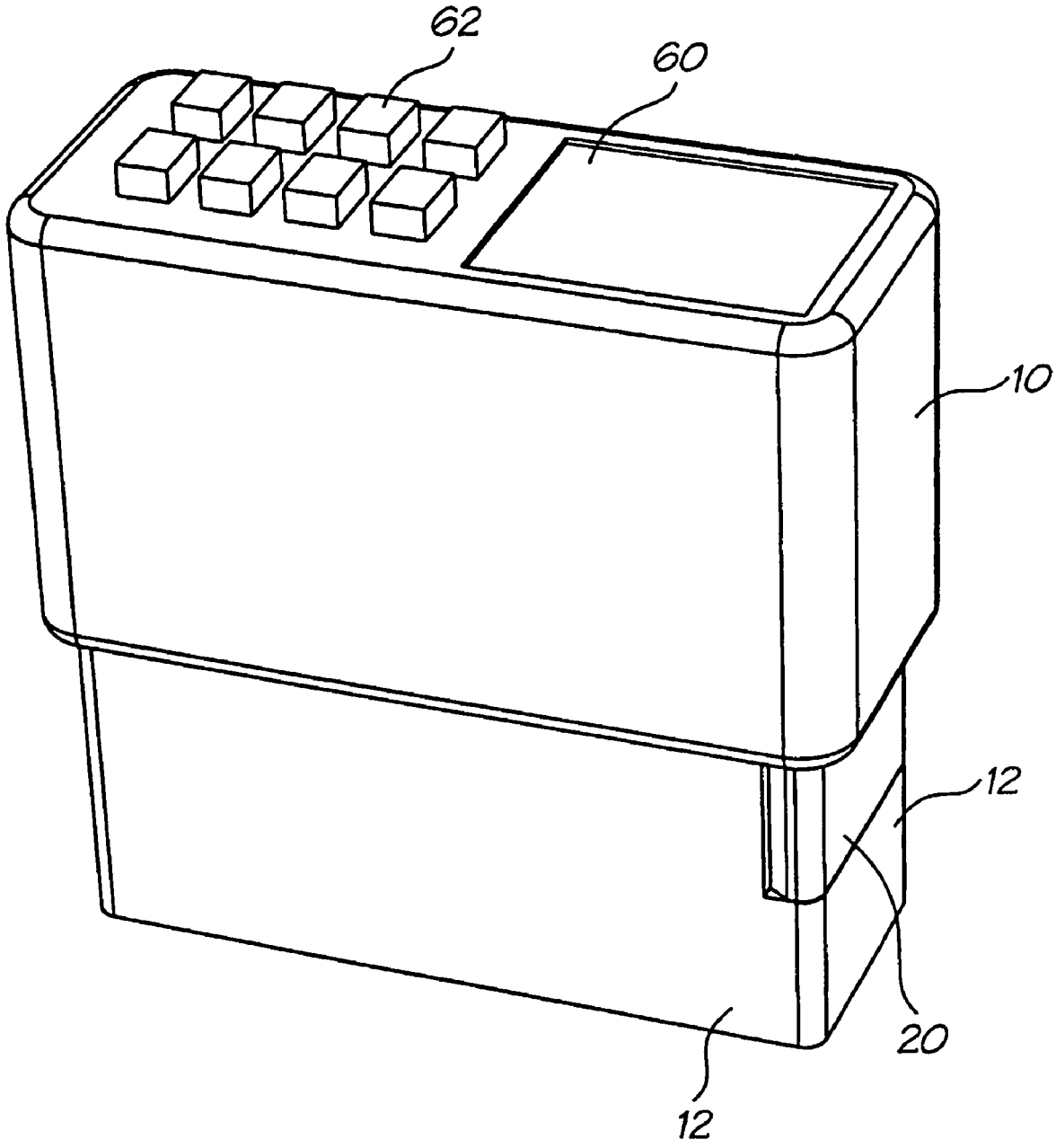
FIG. 8 shows schematically a second embodiment of the invention.

In FIG. 8, a pre-programmed stamp is shown. A fixed message is, for example, provided in a ROM associated with the circuitry driving the printhead. The message may be displayed on an LCD 60 on the face of the stamp and may be further programmable by a set of select buttons, keys or toggles 62 which may, for example, present a time or a date to be printed out with the fixed word, message or image.

In FIG. 9, a programmable stamp is shown which has a connector socket 70, for example a USB (universal serial bus) connector for connecting to a portable or fixed computer which can be used to program or provide input via the USB to the stamp for printing out a message made up via the keyboard or mouse of said portable or fixed computer.

Figure 10:
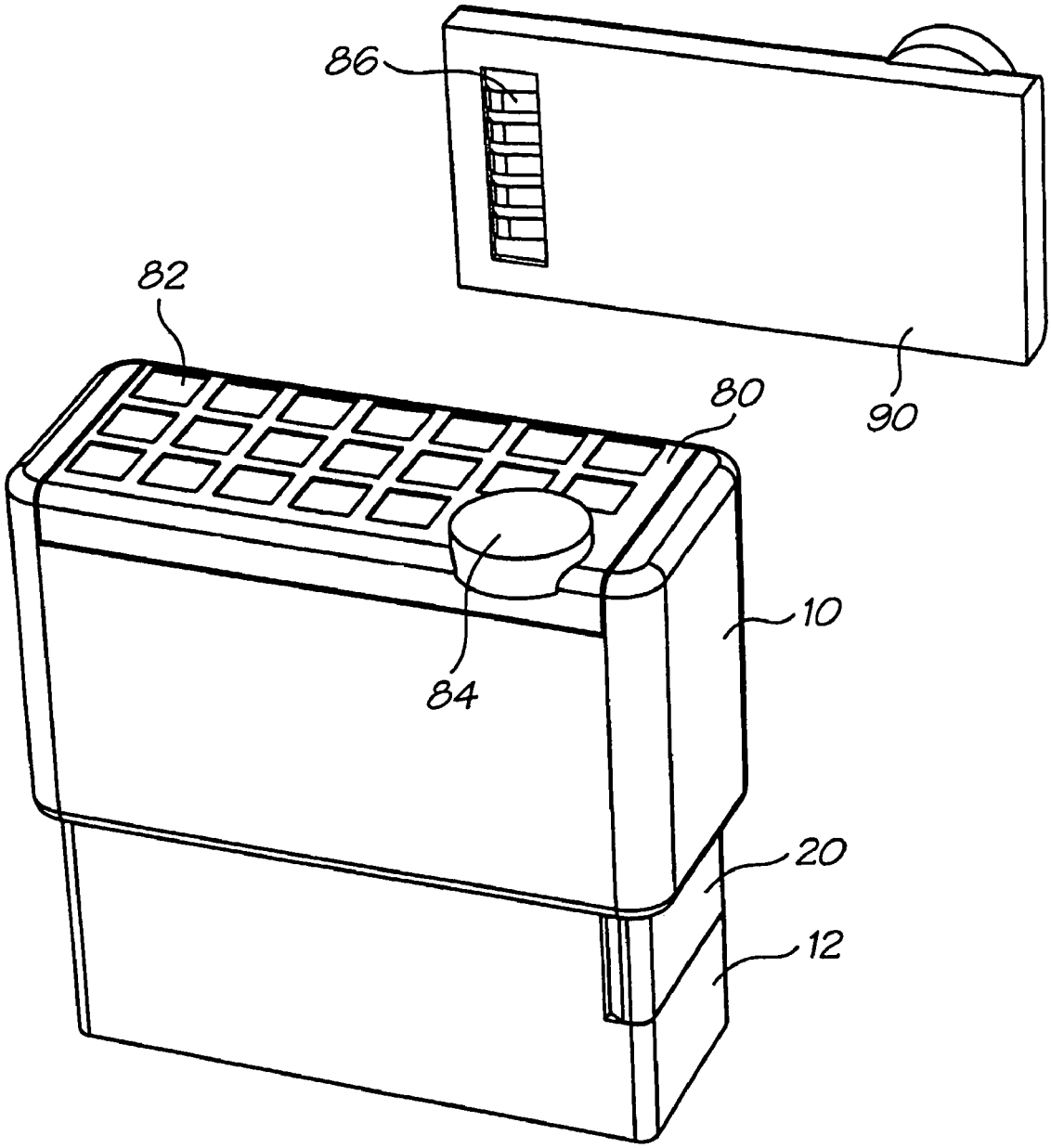
FIG. 10 shows schematically a fourth embodiment of the invention.

In the embodiment shown in FIG. 10, a stamp is made with a removable module 80 which can be clipped onto top housing 10 and has a number of selectable printable elements 82 which can be selected by the selection dial 84. For example, the material that may be selected may be character images of a type such as Mickey Mouse, or Simpsons characters. Module 80 may be removed and replaced by a separate module 90 to provide a different selection of characters allowing the stamp to be selectively "programmed". Contacts 86 in the base of a module 80, 90 allow the information for the printing of the selected character(s) to be transferred to the processing circuitry of the stamp housing.

Figure 11:
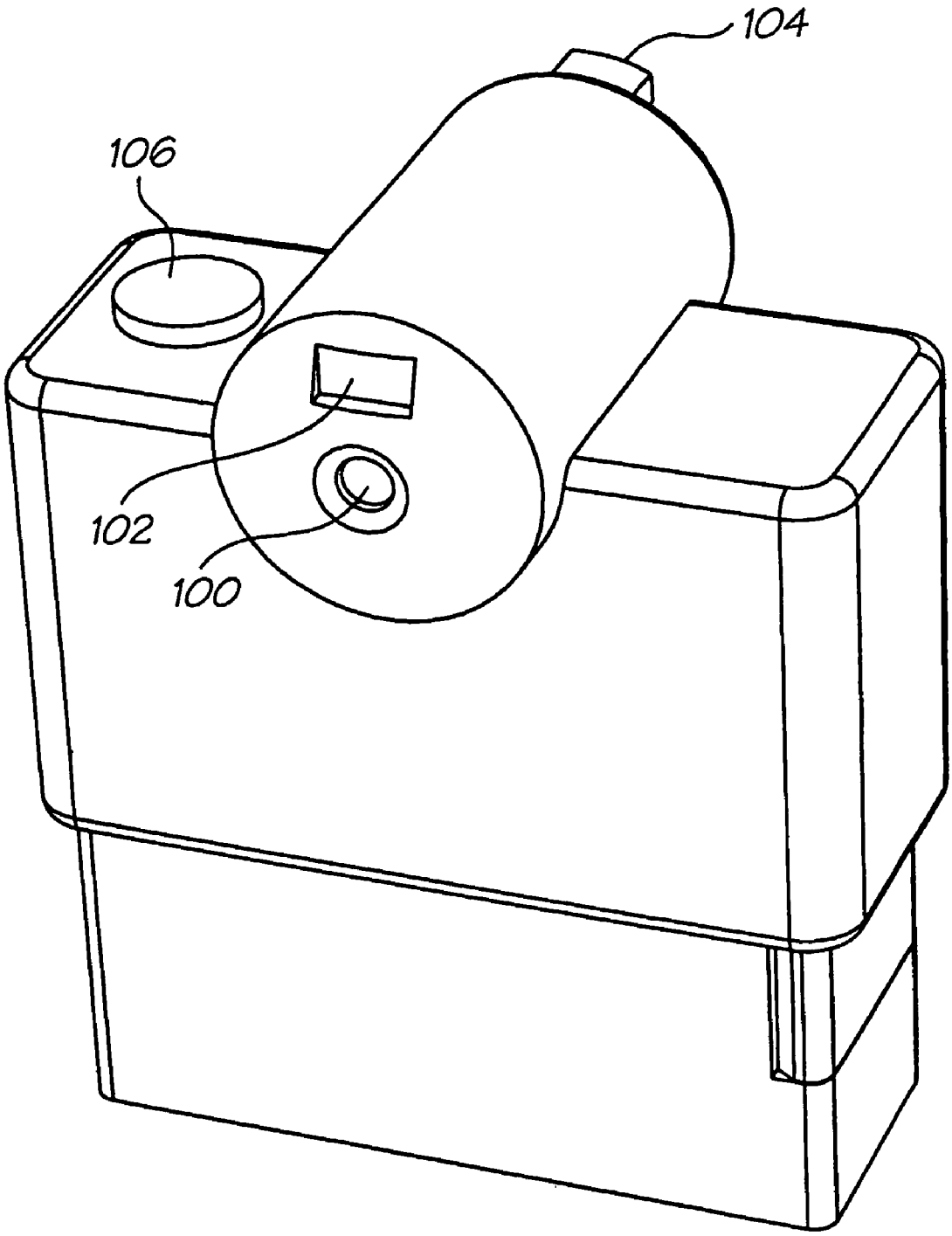
FIG. 11 shows schematically a fifth embodiment of the invention.

As shown in FIG. 11, a stamp is provided which has an attached lens 100, view finder 102 and image sensor 104, the latter two for example being a LCD 102 and a charge coupled device (CCD) 104 respectively, making in effect a miniature camera. The CCD 104 can be used to take a picture of a scene using the button 106 while displaying the scene on the viewfinder 102. The image can then be stored and printed out using the printhead 30 in the manner such as disclosed in the applicant's Artcam applications for example as described in U.S. Pat. No. 6,152,619. The stamp may also be provided with a processor unit which can add other details to the image taken by the CCD 104, for example, the time and date or some text. The stamp may also be provided with a programmable input, such as disclosed with respect to the embodiment of FIG. 9, whereby, for example, the time and date or the name of the author of the photograph or image may be applied thereto when printed out.

Figure 13:
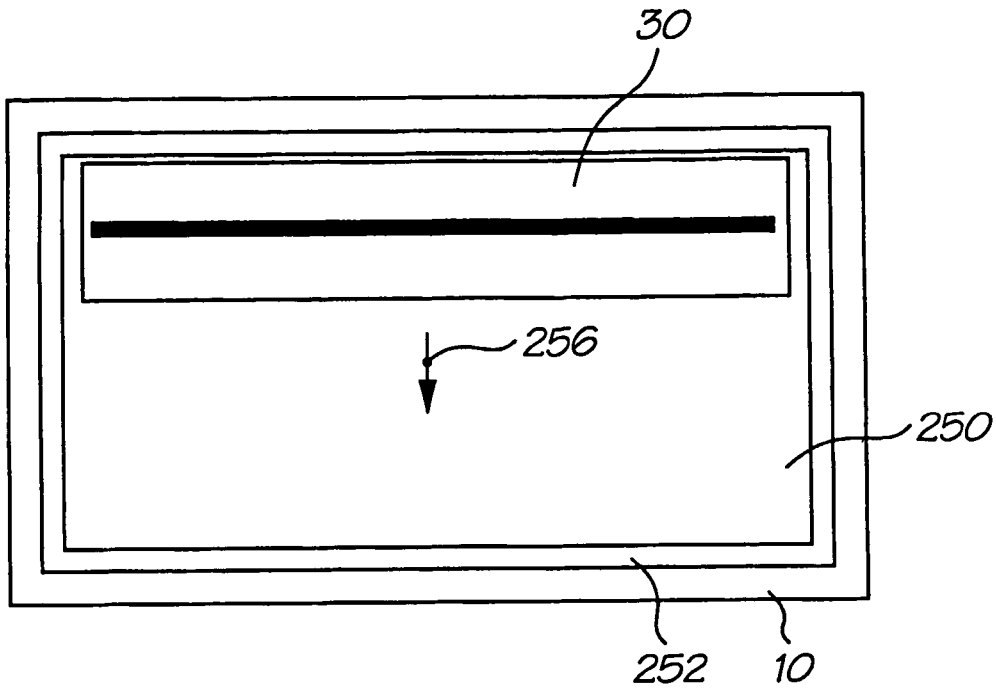
FIGS. 12 and 13 show schematically two alternative embodiments for positioning the printhead in the aperture of the stamp.
Figure 12:
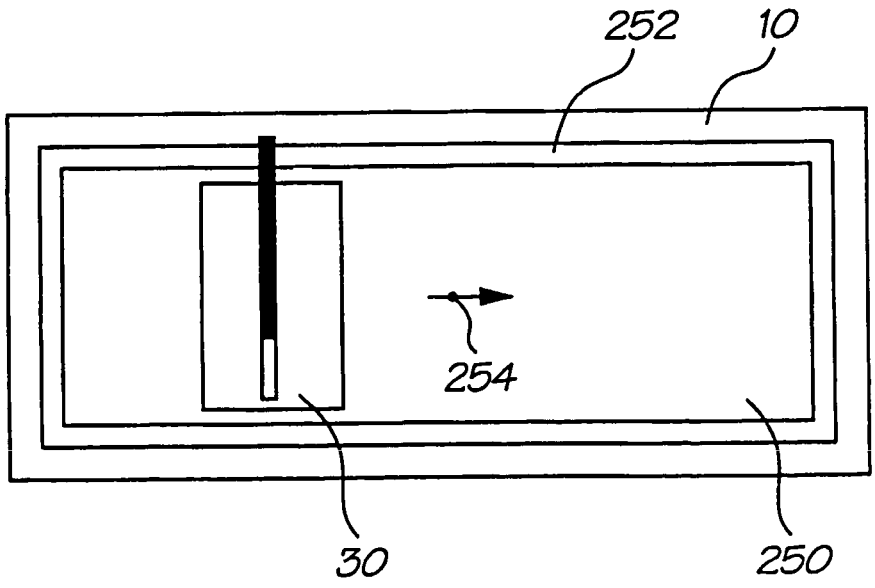

The stamp may be used to replace the prior art rubber stamps used in office environments but may also be used in a variety of other situations, for example, to print a barcode and/or price on a tag or label with the tag or label fixed to the product or separate therefrom. In the latter case, an embodiment such as described with respect to FIG. 9 may be used whereby the stamp is connected via a connector such as an USB to the inventory computer in a supermarket or retail store which loads the details of a barcode and/or price for printing by the printhead 30. The printhead 30 is, for example, as described in U.S. Pat. No. 6,152,619 a linear inkjet printhead having from 1 up to 6 colour jets which are arranged in a linear columnar configuration printing a column of dots in each colour as the printhead traverses the aperture in the base of the stamp. The printhead 30 may be positioned in the opening 250 in the base 252 of the stamp to move along either the long axis 254 or the short axis 256 of the opening 250 as shown respectively in FIGS. 12 and 13. Such printheads may have a resolution of up to 1600 dots per inch allowing the printing of a detailed monochrome or colour strip. In addition, if an infra-red ink is used an invisible watermark or security code may be included with the visible printed matter. The width of the strip will vary depending upon the size of the printhead used but a print head has a typical width of 5–8 mm. A wider printhead can be provided by overlapping more than one such printhead.

The foregoing description has been limited to specific embodiments of this invention. It will be apparent, however, that variations and modifications may be made to the invention, with the attainment of some or all of the advantages of the invention. For example, it will be appreciated that the invention may be embodied in hardware and/or software in a suitably programmed device, both aspects of which are readily accomplished by those of ordinary skill in the respective arts. Therefore, it is the object of the appended claims to cover all such variations and modifications as come within the true spirit and scope of the invention.

I claim:

1. A marking device for printing indicia on print media, the marking device including:

a housing comprising a base housing, an upper housing moveable with respect to the base housing and an opening in said base housing defining a printing zone;

a printing mechanism within the housing, including: a printing means for printing said indicia through said opening; storage means for storing information required to print said indicia said storage means including memory means; moving means for moving said printing means with respect to said housing and said print media during printing; ink supply means fixed relative to part of the housing, the ink supply means supplying ink to the printing means via at least one flexible tube; and processor means for processing said information and for controlling said printing means to print said indicia as said printing means is moved with respect to said print media;

wherein compression of the housing causes the upper housing to move with respect to the base housing, said compression causing said moving means to move said printing means across said opening; and wherein said moving means comprises an arm pivotally attached at a first end to said printing means and pivotally attached at a second end to said upper housing, the marking device further including guide means to constrain motion of the printing means to a linear motion across the opening;

wherein said ink supply means includes an ink connector compartment disposed between an ink cartridge and the at least one flexible tube;

wherein said ink cartridge is replaceable and comprises: a body;

one or more flanges at an exterior face of said body, said one or more flanges being received in a recess of at least one side wall of said base housing; said one or more flanges providing a gripping portion for removal of said body from said base housing;

wherein said body is received in said base housing such that said exterior face of said body is mounted flush with said base housing such that said body does not impede the movement of said upper housing with respect to said base housing.

2. A marking device as claimed in claim 1, wherein said base housing and said upper housing are moveable with respect to each other between a rest position and an end position, the device being configured such that relative movement from the rest position to the end position causes the moving means to move the printing means in a printing movement from a start position to a finish position relative to a substrate upon which the device is being used.

3. A marking device as claimed in claim 2, wherein the moving means further comprises a resilient means attached to said printing means for returning said printing means to said rest position after said end position has been reached.

4. A marking device as claimed in claim 3, wherein said storage means includes solid state random access memory means and stores information for printing a plurality of indicia, the marking device further including switch means configured to enable a user to select between one or more of the plurality indicia for printing.

5. A marking device as claimed in claim 4, wherein said switch means is a slide switch.

6. A marking device as claimed in claim 4, wherein said switch means is a rotary switch.

7. A marking device as claimed in claim 4, wherein said switch means is electronic.

8. A marking device as claimed in claim 4, wherein said solid state random access memory means stores information for printing a plurality of indicia, the marking device further including switch means configured to enable a user to select between one or more of the plurality indicia for printing.

9. A marking device as claimed in claim 8 wherein said switch means is a rotary switch.

10. A marking device as claimed in claim 8, wherein said switch means is electronic.

11. A marking device as claimed in claim 2, configured to convert downward movement of the upper housing supplied by a user's hand into lateral movement of the printing means.

12. A marking device as claimed in claim 1, wherein said ink supply means includes a supply of a plurality of inks, said ink connector compartment includes a corresponding plurality of respective connections to said at least one flexible tube, said printing means including a corresponding plurality of sets of inkiet nozzles for printing with said plurality of inks.

13. A marking device as claimed in claim 12, wherein said ink supply means includes means of storing at least an infrared ink and another ink, said printing means including a plurality of inkjet nozzles for printing with at the two inks.

14. A marking device as claimed in claim 1, wherein the printing mechanism includes an inkjet printhead including a plurality of nozzles formed by microelectromechanical means.

15. A marking device as claimed in claim 14, wherein the inkjet printhead is a full color printhead.

16. A marking device according to claim 1 wherein the guide means includes a slot in said base housing and one or more bearings fixed to the printhead that engage in said slot.

* * * * *